US006789477B2

(12) United States Patent
Rogge et al.

(10) Patent No.: US 6,789,477 B2
(45) Date of Patent: Sep. 14, 2004

(54) FLEXOGRAPHIC PRINTING MACHINE WITH ALTERNATELY MANUALLY AND AUTOMATICALLY ADJUSTABLE SPIRAL ROLLERS

(75) Inventors: Guenter Rogge, Lienen (DE); Klaus Lapehn, Osnabrueck (DE); Dietmar Koopmann, Lienen-Kattenvenne (DE)

(73) Assignee: Windmoeller & Hoescher KG, Lengerich (DE)

( * ) Notice: Subject to any disclaimer, the term of this patent is extended or adjusted under 35 U.S.C. 154(b) by 0 days.

(21) Appl. No.: 10/261,948

(22) Filed: Oct. 2, 2002

(65) Prior Publication Data

US 2003/0089255 A1 May 15, 2003

(30) Foreign Application Priority Data

Nov. 9, 2001 (DE) ..... 101 55 256

(51) Int. Cl.[7] ..... B41F 13/24
(52) U.S. Cl. ..... 101/248; 101/247; 101/153
(58) Field of Search ..... 101/247, 248, 101/152, 153, 154, 155, 156, 157, 170

(56) References Cited

U.S. PATENT DOCUMENTS 1,451,726 A * 4/1923 Zuckerman ..... 101/153
3,738,265 A * 6/1973 Saueressig ..... 101/152
4,413,541 A * 11/1983 Biggar, III ..... 83/346
4,729,309 A * 3/1988 Saterini et al. ..... 101/152
5,528,986 A * 6/1996 Andersson et al. ..... 101/219

FOREIGN PATENT DOCUMENTS

| | | |
|---|---|---|
| DE | 92 09 455 | 1/1993 |
| EP | 0 438 716 | 7/1991 |

* cited by examiner

*Primary Examiner*—Daniel J. Colilla
*Assistant Examiner*—Jill E. Culler
(74) *Attorney, Agent, or Firm*—Jacobson Holman PLLC

(57) ABSTRACT

A flexographic printing machine having at least one inking unit in which the setting of the printing position of the format cylinder and the anilox roller can be achieved by adjusting the format cylinder to the impression roller and the anilox roller to the format cylinder using adjustment equipment. The setting of the printing position of the format cylinder and/or the anilox roller is achieved by manually operating this adjustment equipment, while the removal of the format cylinder and/or the anilox roller from the previously manually set position and the readjustment of these rollers into the same position can be achieved using at least one drive.

19 Claims, 5 Drawing Sheets

FLEXOGRAPHIC PRINTING MACHINE WITH ALTERNATELY MANUALLY AND AUTOMATICALLY ADJUSTABLE SPIRAL ROLLERS

BACKGROUND OF THE INVENTION

1. Field of the Invention

The invention is a flexographic printing machine which is equipped with at least one inking unit in which the setting of the printing position of the format cylinder and the anilox roller can be achieved by adjusting the format cylinder, the impression roller and the anilox roller up to the format cylinder with adjusting equipment, as well as a method to operate the same.

2. Description of the Related Art

Flexographic printing machines of the type identified above are known. Thus, DE 092 09 455 U1 and EP 0 438 716 B1 exhibit machines of this type. These patents also clarify that the adjusting equipment with which force or torque are transferred to the bearings of the anilox roller and of the format cylinder in order to position these rollers can vary in how much they stick out. As a rule, they comprise gears, spindles, grooves and carriages.

Since in flexographic printing machines it is necessary to position the format cylinder precisely on the impression roller and the anilox roller precisely on the format cylinder, and since this expensive and meticulous adjustment process must be repeated again and again when changing material, when there are tears in the printing sheet, when changing printing blocks or the entire format cylinder, etc., drives that work precisely but rapidly, e.g., stepping motors, are used in these adjusting processes. These drives are very expensive. Thus the purpose of the present invention is to show a flexographic printing machine with which more economical drives can be used.

SUMMARY OF THE INVENTION

The purpose is resolved by a flexographic printing machine which is equipped with at least one inking unit in which the setting of the printing position of the format cylinder and the anilox roller can be achieved by adjusting the format cylinder, the impression roller and the anilox roller up to the format cylinder with adjusting equipment. The adjustment of the printing position of the format cylinder and/or the anilox roller is done by manually operating this adjustment equipment and, thereafter, the removal of the format cylinder and/or the anilox roller from the previously manually set position, as well as the readjustment of these rollers into the same position, can be achieved using at least one drive.

Relatively economical motors can then be used as drives. In this connection it is beneficial if such a drive has a stop. This stop can be a component of the gear and, if needed, can also be adjusted when manually adjusting the roller position. At least one of these stops, however, can also be a standard component of the drive. There are even drives that work during operation between two stops and permit only limited turns (for example, 180°).

Additional beneficial embodiments and examples of the embodiment are produced from the additional claims, the concrete description, and the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
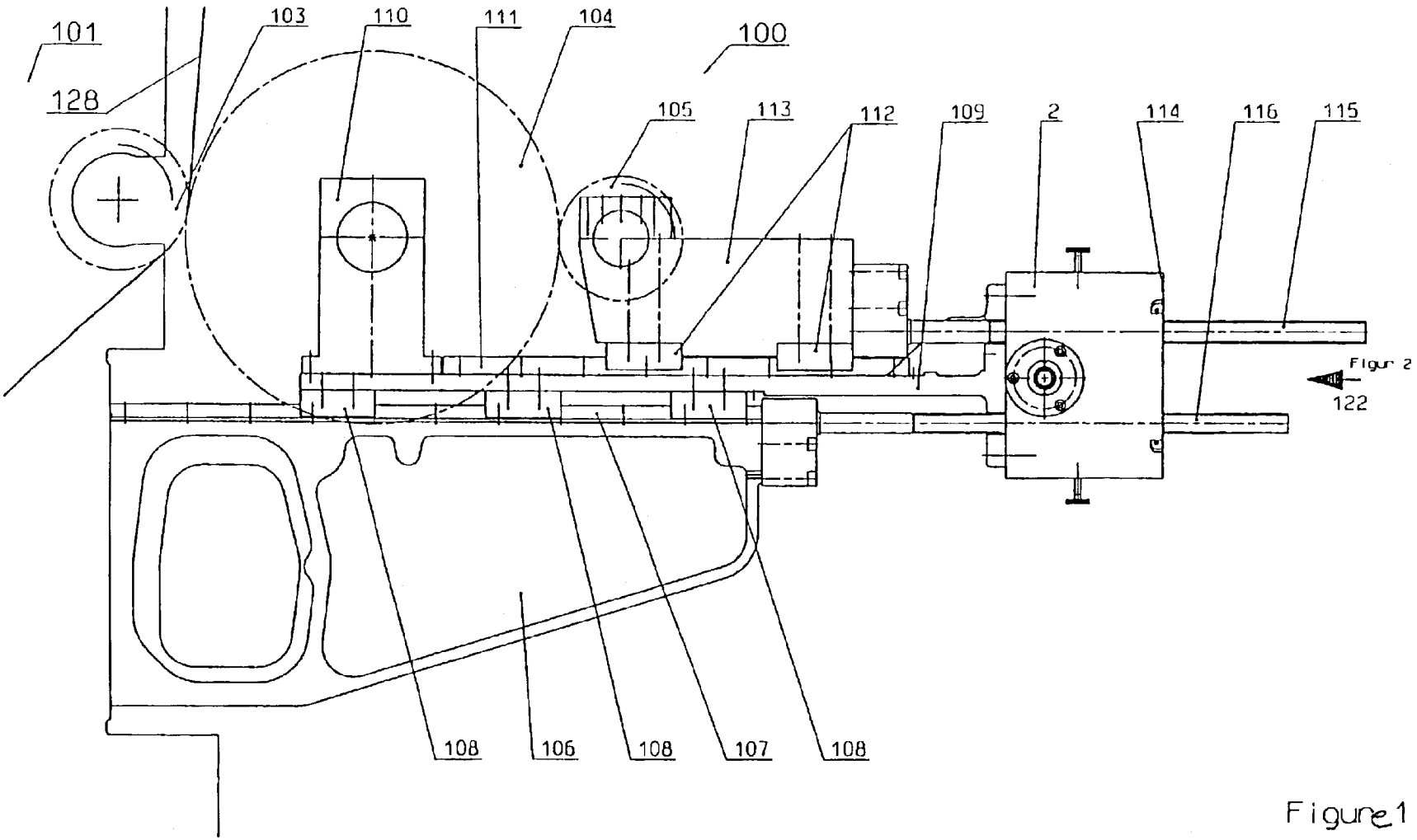
FIG. 1 A lateral view of an inking unit of a flexographic printing machine that is equipped with an example of the embodiment of a device consistent with the invention.

FIG. 1 shows a lateral view of an inking unit 100 of a flexographic printing machine 101 consistent with the invention. The inking unit comprises among other things the format cylinder 104 that is arranged against the impression roller 103 and the anilox roller 105 that is arranged against the format cylinder 104. The components of the inking unit 100 sit on the console 106 of the inking unit. The linear guide 107 of the format cylinder is attached directly onto this console. Carriages 108 slide on this linear guide 107, on which carriages the brace 109 of the format cylinder slides over the linear guide 107. This angle brace carries both the bearing 110 of the format cylinder 104 as well as the linear guides 111 of the anilox rollers, on which in turn the carriages 112 of the anilox rollers slide. For this reason one speaks of a piggyback carriage with such an arrangement.

It is also usual to provide the carriages of both spiral rollers 104, 105 of inking units of flexographic printing machines with angle braces 109, 113, which are handled completely independently from each other.

Such a piece of equipment is not shown by the figures but is nevertheless consistent with the invention if the printing position of the format cylinder and/or the anilox roller is adjusted by manually operating adjusting equipment (2, 115, 116, 108, 112, 107, 111) and whereby the removal of the format cylinder (104) and/or the anilox roller (105) can be achieved from the previously manually set position and the readjustment of these rollers (104, 105) into the same position using at least one drive (124).

Figure 2:
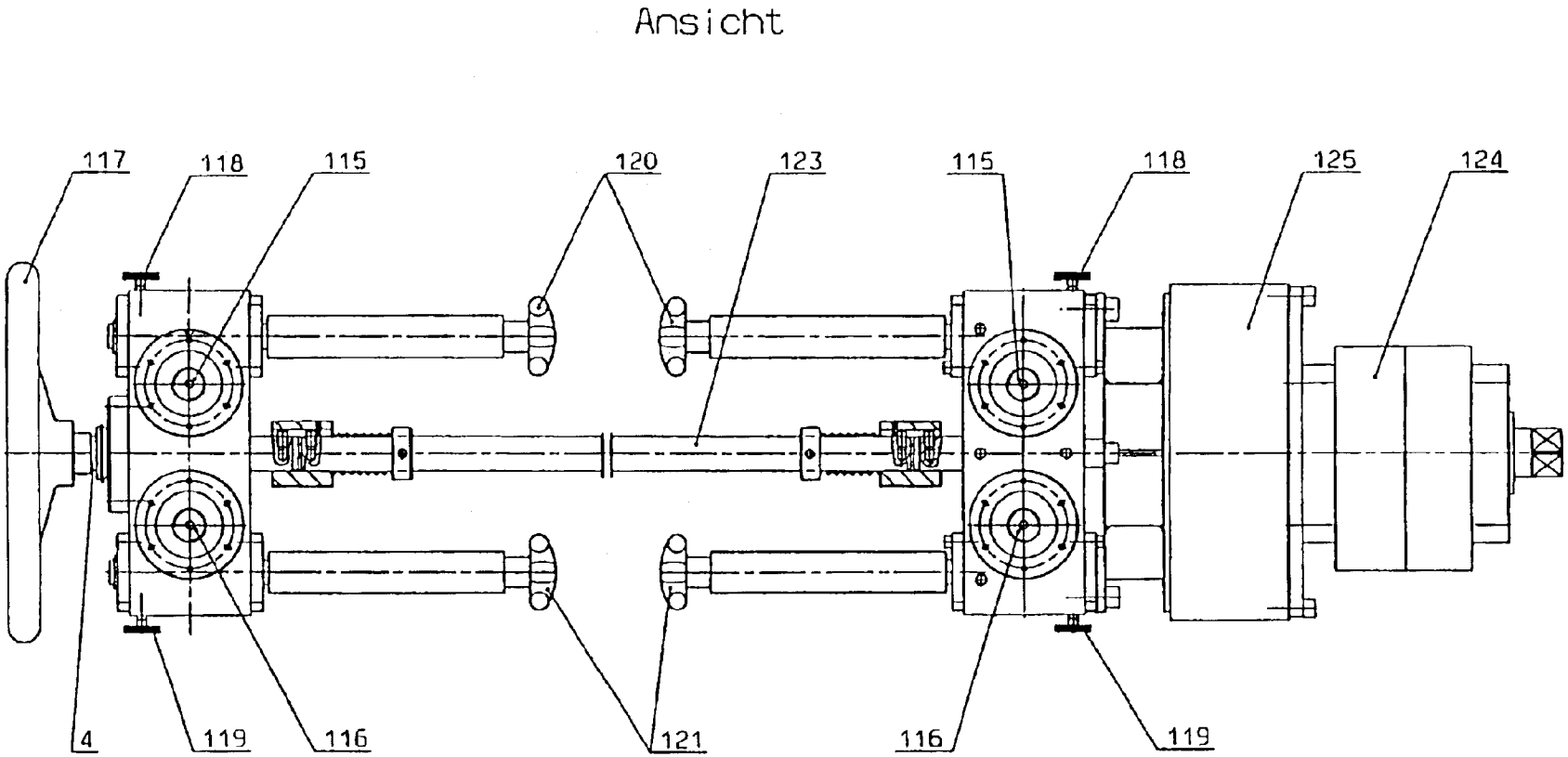
FIG. 2 A view of the gear components of the inking unit from the angle of view shown by arrow 122 in FIG. 1.

On the carriage 112, the anilox roller 105 is stored in the brace 113. Spindles 115, 116 on the linear guides 107, 111 move both carriages 108, 112. The spindles reach through the gear 2 (FIG. 2). The hand wheel 117 can be recognized on the front end of the gearbox. Both locking screws 118 and 119 serve to specify the precision adjustments 120, 121 for both spindles, which can be seen in FIG. 2.

FIG. 2 is a view of the gear components of the inking unit from the angle of view shown by the arrow 122. The printing unit's elements situated behind the gears 2 seen from the viewing direction are not shown in this figure. FIG. 2 makes clear that both the angle brace 109 of the format cylinder 104 as well as the brace of the anilox rollers are each assigned to two spindles 115, 116, which are moved by two gears 2. Both of these gears 2 have been arranged to a great extent as mirror images of each other. The drive of the central helical gear wheels 4 of both gears 2, which are connected by a shaft 123, can however by undertaken both by the hand wheel 117 on the left side of the picture as well as by the drive 124. The drive is achieved pneumatically in the example of the embodiment shown, whereby the drive has a front and a rear stop, which limits the stop motion of the motor. The drive is connected via a coupling 125 with the central helical gear 4 of the right gear 2. The coupling guarantees both the ability of the drive to disconnect from the helical gear as well as the gear's ability to manually rotate when the motor is not running. A cover covers the shaft 123.

Figure 3:
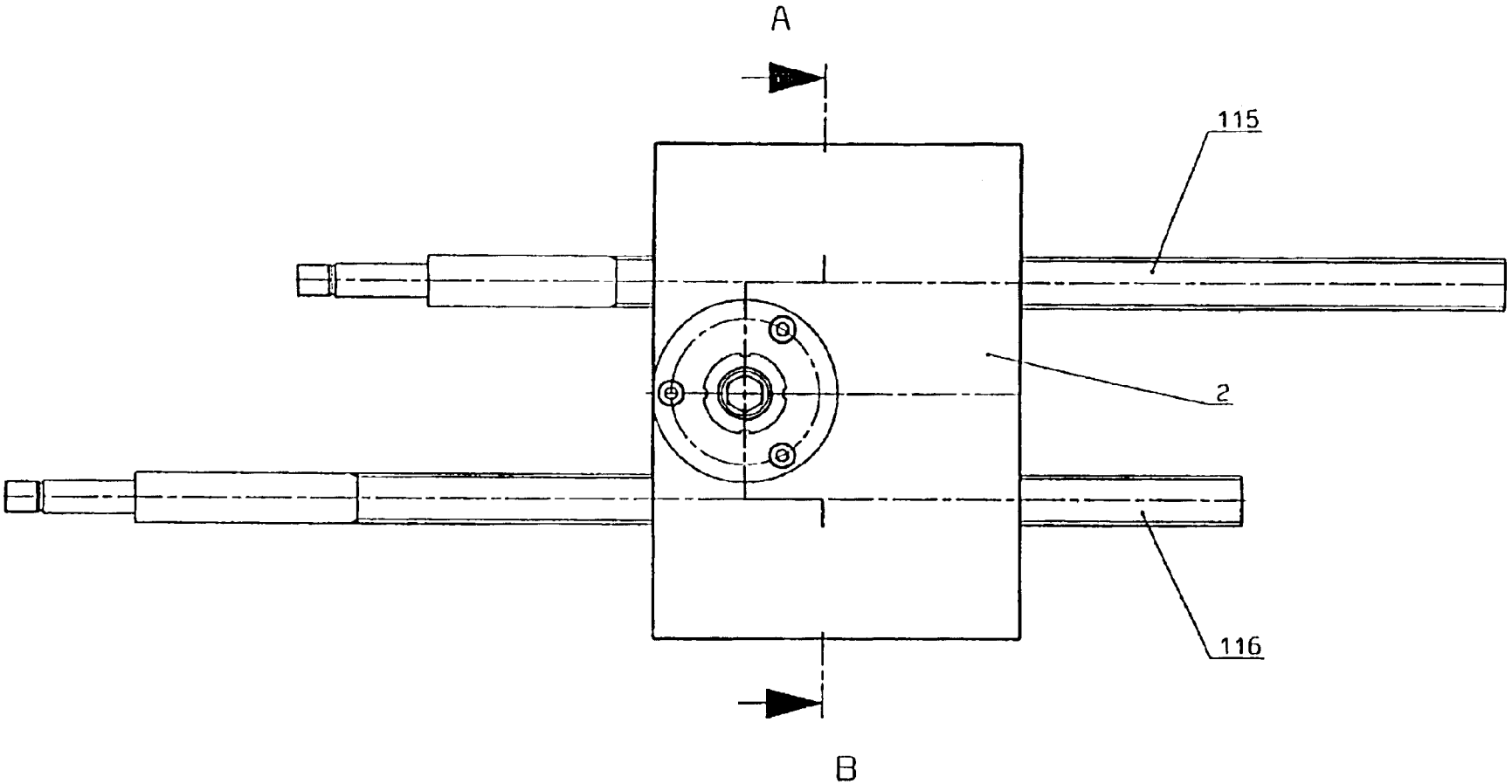
FIG. 3 A view of the manually operated side of the gear.
Figure 4:
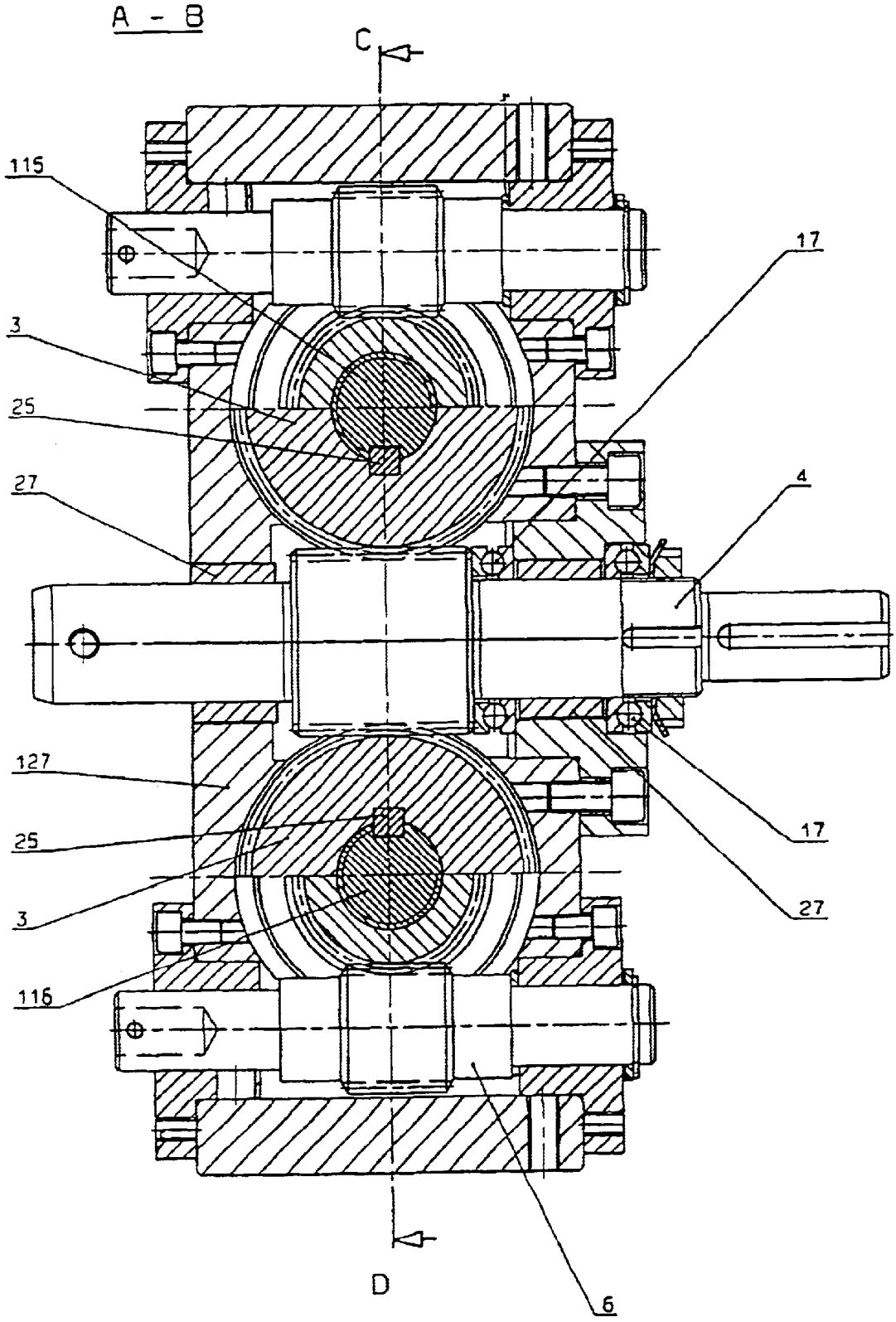
FIG. 4 Section A–B from FIG. 3.
Figure 5:
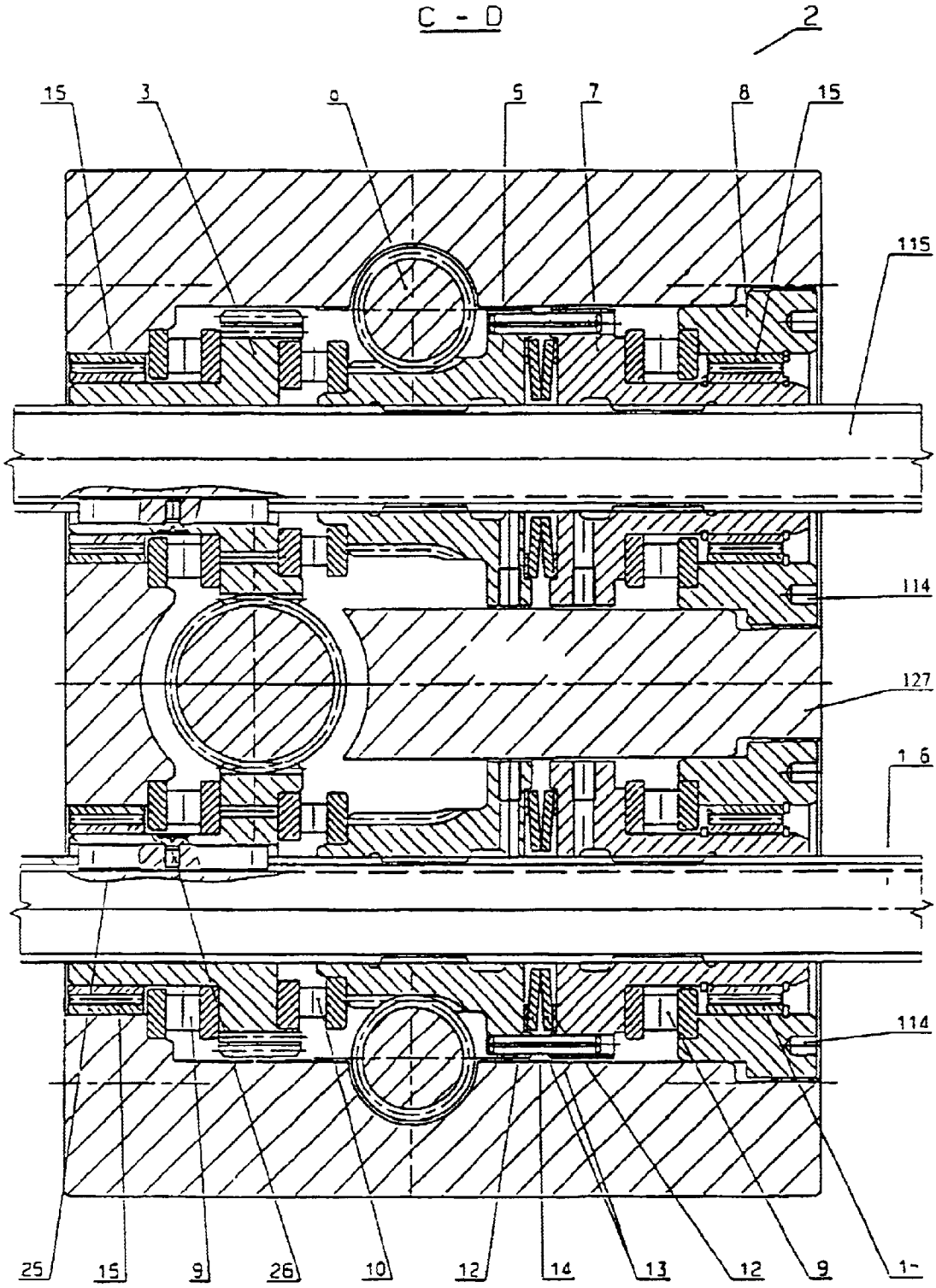
FIG. 5 Section C–D from FIG. 3.

FIG. 3 shows once again the manually operable side of the gear 2 and makes clear the position of the carriage A–B that is shown in FIG. 4. FIG. 4 for its part makes clear the position of the carriage C–D that is shown in FIG. 5. The inner mechanism of the gear 2 can be understood in the context of the two last mentioned figures.

What stands out at first is that the gear elements, located above and/or below the central helical gear 4, are designed as mirror images of each other. The setup and/or operation of both spindles 115, 116 is thus done in same way so that only a half of the gear need be described at this point.

Rolling bearings 17 and plain bearings 27 support the central helical gear 4. The helical gear 4 is in screw-shaped contact with the gearwheel 3, which is also rotated when the central helical gear wheel 4 is rotated either by the hand wheel 117 or the drive 124.

Here, the axis of rotation of the gear wheel 3 is orthogonal to the axis of rotation of the central helical gear wheel 4. The gear wheel 3 is its rotation also turns the spindle 115 since the parallel key 25 forces both of these gear elements to rotate jointly around their common main inertia axis. This rotation of the spindle 115 in turn results in translational motion thereof since the spindle sits in the nut 5 that is locked in the axial direction.

In the example of the embodiment shown, the rough adjustment of the roller positions is done in the described way, whereby both spindles are moved simultaneously. The precision adjustment of the spindles 115, 116, however, is done individually by manually setting the precision adjustments 120, 121 that drive both screws 6. Each of these two screws in turn is in contact with the spiral gear 5 and the nut 7. Thus, a rotation of the screw 6 around its 6 main inertia axis results in rotation of the spiral gear 5 and the nut 7. Both of the latter components 5, 7 are guided in any case through the cylindrical pin 14 in their circular direction and together form a two-piece nut, which—as already mentioned—cannot be appreciably repositioned in the axial direction of the spindle since it is prevented from such translational motion by the caster roller bearings 9 and 10. These caster roller bearings 9, 10 do permit the rotation of the nuts 5, 7 around their main inertia axis, however.

Rotation of an otherwise stationary, two-piece nut 5, 7 thus results in translational motion of the corresponding spindles 115, 116, which do not rotate when being precision-adjusted this way since otherwise the overall mimicry of the rough adjustment 4, 3, 25 would have to rotate as well. The described translation motion of the spindles stopped in the circular direction during their individually undertaken precision adjustment does not create any force between the mimicry of the rough adjustment 4, 3, 25 and the mimicry of the precision adjustment 6, 7, 5, 14, however, since the mimicry of the rough adjustment does not create any resistance to the translation motion during precision adjustment. On the contrary, the spindles 115, 116 slide along the parallel key 25, which reaches into a nut in the spindles 115, 116 (FIG. 4). The parallel key for its part is screwed with the screw 26 onto the gear wheel 3 and is thus also secured against translation motion in the spindles 115, 116.

Also noteworthy is the functioning of the needle roller bearings 15 that can be seen in FIG. 5 and that store the spindles 115, 116 in the box 127 for the gear 2 and/or in the tapped bushings 8 and permit the rotation of the spindles. The tapped bushings 8 can be rotated for their part in a thread in the gearbox 127 around their main inertia axis. The response rotation is executed by inserting pins from a suitable turning tool into the drill holes 114 in the tapped bushing 8 such that the tapped bushing 8 can be turned with the tool. By turning the tapped bushing 8, the position thereof can be adjusted from outside the axial direction of the spindle. In this way it is possible, with limited translational motion of the tapped bushing 8, to set the restoring force of the plate springs 13 against the connecting disc 12. Suitable restoring force in these springs ensures that the whole gear functions without any play. It may be necessary from time to time to readjust or set the restoring force of the springs.

With such adjustment equipment, the rollers involved in the printing process can be adjusted in the following way.

First, using the hand wheel 17, a rough adjustment of the position of the anilox roller 105 and the format cylinder 104 is made. This rough adjustment can be further improved by operating the precision adjustments 120, 121. The precision adjustment is done individually for the anilox roller 105 and for the format cylinder 104.

The printing process is started in the adjusted position. If after the printing sheet 128 tears there is need to remove the anilox roller and the format cylinder from the impression roller, the torque needed for this is acquired from the drive 124 and transferred via the coupling 125 to the central helical gear. The drive 124 has two integrated and thus not-diagrammed stops at its disposal simultaneously that restrict its torque. Thus, the drive 124 turns the central helical gear 4 around a fixed angle, whereby the rotor of the drive rotates from the front to the rear stop. In this way, the stop movement of the anilox roller and the format cylinder is brought about. After changing sheets, the drive is again operated in the opposite direction, whereby the rotor of the drive again reaches the front stop. In this way, the anilox roller 105 and the format cylinder 104 return to the original, manually set printing position.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A flexographic printing machine having at least one inking unit, comprising:

a format cylinder, an anilox roller and an impression roller having a printing position;

adjusting equipment including a manual operation tool and a gear mechanism for transmitting rotational force to a spindle in order to set the printing position by manually adjusting the format cylinder and the anilox roller up to the impression roller to achieve a manually set position; and a drive mechanism for conducting rotational force to said spindle for removal of said format cylinder and/or said anilox roller from said manually set position and for readjustment back to said manually set position on an automated basis.

2. The flexographic printing machine as set forth in claim 1, further comprising a central helical gear that works in conjunction with both said manual operation tool and said drive mechanism in effecting the adjustment, removal and readjustment of said format cylinder and anilox roller.

3. The flexographic printing machine as set forth in claim 2, wherein said adjusting equipment includes a pair of spaced gear mechanisms and a corresponding pair of spindles, each gear mechanism having a respective gear wheel coupled to a respective spindle for joint rotation therewith, said gear mechanisms being connected by a shaft in engagement with said central helical gear such that rotation of said central helical gear rotates both spindles.

4. The flexographic printing machine as set forth in claim 3, wherein an axis of rotation of said gear wheels and spindles is generally orthogonal to an axis of rotation of said central helical gear.

5. The flexographic printing machine as set forth in claim 2, wherein said drive mechanism includes two integrated stop positions such that the drive mechanism turns the central helical gear around a fixed angle.

6. The flexographic printing machine as set forth in claim 1, wherein said manual operation tool is a hand wheel.

7. The flexographic printing machine as set forth in claim 1, further comprising a coupling for separating the drive mechanism from the manual operation tool.

8. The flexographic printing machine as set forth in claim 1, wherein said adjustment equipment further includes a precision adjustment mechanism for driving a screw within the gear mechanism to effect movement of the spindle.

9. A flexographic printing machine having at least one inking unit, comprising:

a format cylinder, an anilox roller and an impression roller having a printing position, each of said format cylinder and said anilox roller being supported on a respective brace coupled to a respective spindle;

adjusting equipment including a pair of spaced gear mechanisms connected by central helical gear wheels to a shaft for transmitting rotational force to said spindles which pass through said gear mechanisms, said adjusting equipment having a manual operation tool to set the printing position by moving the spindles to manually adjust the format cylinder and the anilox roller up to the impression roller to achieve a manually set position; and a drive mechanism coupled to at least one of said gear mechanisms for conducting rotational force to said spindles via said central helical gear wheels to remove said format cylinder and/or said anilox roller from said manually set position and to effect readjustment back to said manually set position on an automated basis.

10. The flexographic printing machine as set forth in claim 9, wherein an axis of rotation of said spindles is generally orthogonal to an axis of rotation of said central helical gear wheels.

11. The flexographic printing machine as set forth in claim 9, wherein said drive mechanism includes two integrated stop positions such that the drive mechanism turns the central helical gear wheels around a fixed angle.

12. The flexographic printing machine as set forth in claim 9, further comprising a coupling for separating the drive mechanism from the manual operation tool.

13. The flexographic printing machine as set forth in claim 9, wherein said manual operation tool is a hand wheel.

14. The flexographic printing machine as set forth in claim 9, wherein said adjustment equipment further includes a precision adjustment mechanism for driving respective screws within the gear mechanisms to effect movement of the spindles.

15. A method for setting a printing position of a format cylinder and an anilox roller with an inking unit of a flexographic printing machine having an impression roller, comprising the steps of:

manually operating adjustment equipment which rotates a spindle to adjust the format cylinder and the anilox roller with respect to the impression roller to achieve a manually set position; and removing the format cylinder and/or the anilox roller from the manually set position and readjusting said rollers back to said manually set position on an automated basis using a drive mechanism that conducts rotational force to said spindle.

16. The method as set forth in claim 15, wherein said step of manually operating is performed using a hand wheel.

17. The method as set forth in claim 15, wherein in said step of manually operating the adjustment equipment, the format cylinder and the anilox roller are set in position jointly.

18. The method as set forth in claim 15, wherein in said step of manually operating the adjustment equipment, the format cylinder and the anilox roller are set in position individually.

19. The method as set forth in claim 15, wherein in said step of removing and readjusting the format cylinder and/or the anilox roller on an automated basis using the drive mechanism, the format cylinder and the anilox roller are removed and readjusted jointly.

* * * * *